US009726382B2

(12) United States Patent
Jensen

(10) Patent No.: US 9,726,382 B2
(45) Date of Patent: Aug. 8, 2017

(54) HEAT EXCHANGER UNIT HAVING CONNECTORS WITH IDENTICAL BASE ELEMENTS

(75) Inventor: Olav Jensen, Viborg (DK)

(73) Assignee: Grundfos Management a/s, Bjerringbro (DK)

( * ) Notice: Subject to any disclaimer, the term of this patent is extended or adjusted under 35 U.S.C. 154(b) by 1212 days.

(21) Appl. No.: 13/193,912

(22) Filed: Jul. 29, 2011

(65) Prior Publication Data

US 2012/0024504 A1 Feb. 2, 2012

(30) Foreign Application Priority Data

Jul. 30, 2010 (EP) ..... 10 007 976

(51) Int. Cl.

| | |
|---|---|
| ***F28F 27/00*** | (2006.01) |
| ***F24D 3/10*** | (2006.01) |
| ***F24H 9/14*** | (2006.01) |
| ***F28D 9/00*** | (2006.01) |
| ***F28F 9/02*** | (2006.01) |

(52) U.S. Cl.

CPC ..... *F24D 3/10* (2013.01); *F24H 9/14* (2013.01); *F24H 9/142* (2013.01); *F24H 9/148* (2013.01); *F28D 9/005* (2013.01); *F28D 9/0093* (2013.01); *F28F 9/0253* (2013.01)

(58) Field of Classification Search

CPC .... F28D 21/0007; F28D 21/0005; F24H 1/12; F24H 1/14; F24H 1/16; F24H 1/18; F24H 1/208

USPC ..... 165/200, 96, 101, 102, 103, 11.1, 166, 165/167; 137/340; 285/41

See application file for complete search history.

(56) References Cited

U.S. PATENT DOCUMENTS

| | | | | |
|---|---|---|---|---|
| 3,011,681 | A * | 12/1961 | Kromer | 137/12.5 |
| 3,048,375 | A * | 8/1962 | Walker | 165/86 |
| 3,666,003 | A * | 5/1972 | Clark et al. | 165/108 |
| 3,743,011 | A * | 7/1973 | Frost | F01M 1/10 165/167 |
| 3,873,022 | A * | 3/1975 | Hilgemann | F24F 11/06 165/11.1 |
| 4,002,201 | A * | 1/1977 | Donaldson | F28D 1/0333 165/140 |

(Continued)

FOREIGN PATENT DOCUMENTS

| | | |
|---|---|---|
| AT | 390661 B | 6/1990 |
| DE | 2413165 C3 | 5/1986 |

(Continued)

OTHER PUBLICATIONS

EP Search Report issued Dec. 21, 2010 in EP Application No. 10007976.3.

European Opposition issued Nov. 25, 2014 (with English Summary).

*Primary Examiner* — Ljiljana Ciric

(74) *Attorney, Agent, or Firm* — Panitch Schwarze Belisario & Nadel LLP

(57) ABSTRACT

A heat exchanger unit is utilized for heating service water in a heating installation. The unit includes a plate heat exchanger a first connector, attached to a first fluid connection point of the heat exchanger, and a second connector, fastened to the heat exchanger. The first and second connectors each include at least one base element. The base element of the first connector and the base element of the second connector have an identical configuration. Each base element includes at least two distinct flow ducts.

15 Claims, 15 Drawing Sheets

(56) References Cited

Figure 1:
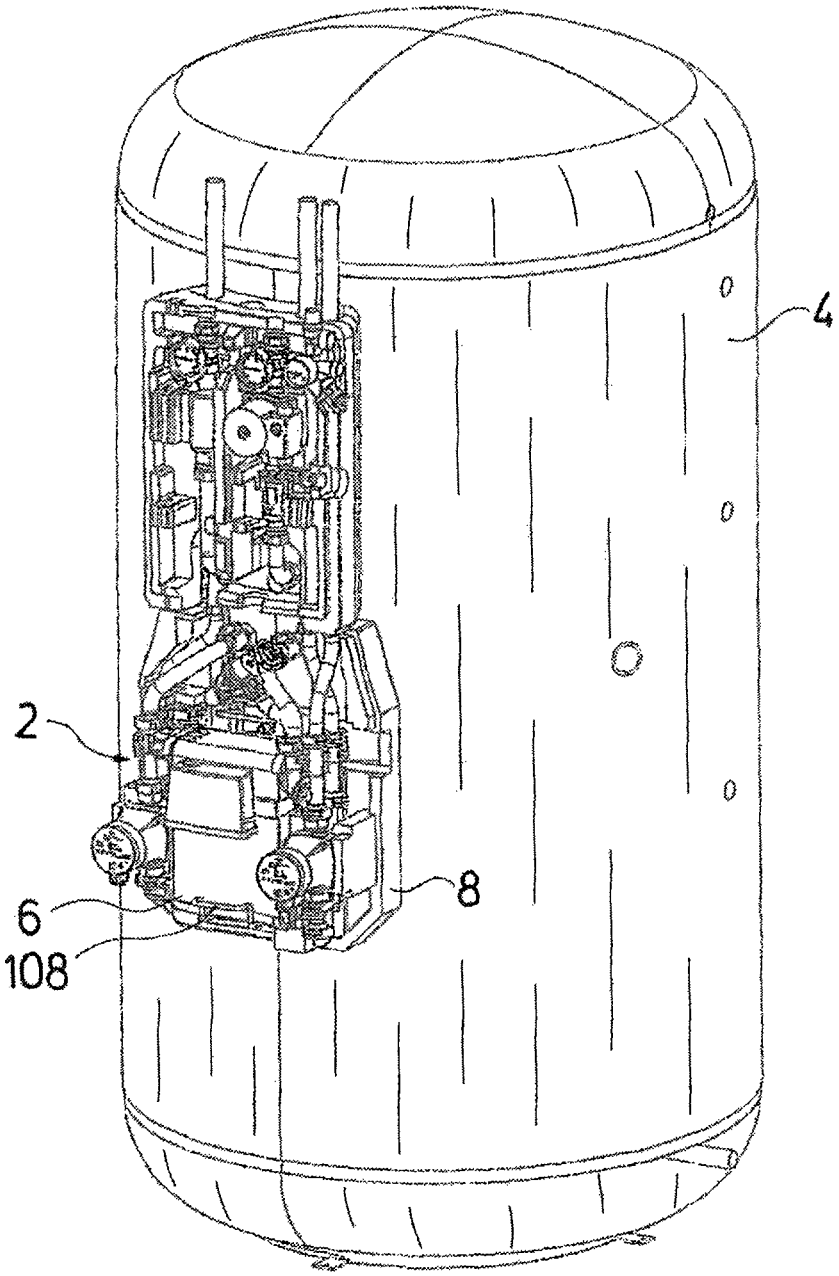

U.S. PATENT DOCUMENTS 4,044,396 A * 8/1977 Haws ..... H05K 7/20336 165/104.14
4,046,189 A * 9/1977 Clark, Jr. ..... 165/108
4,127,164 A * 11/1978 Erwin ..... 165/45
4,129,179 A * 12/1978 Molitor ..... 165/101
4,207,942 A * 6/1980 Cowan ..... F28F 3/083 165/133
4,216,879 A * 8/1980 McMillin ..... 137/340
4,237,969 A * 12/1980 Andre et al. ..... 165/71
4,258,784 A * 3/1981 Perry ..... F28F 3/083 165/166
4,265,303 A * 5/1981 Giurtino ..... A61M 1/32 156/305
4,291,681 A * 9/1981 Berringer ..... F24J 2/201 126/673
4,348,135 A * 9/1982 St. Clair ..... 405/36
4,352,273 A * 10/1982 Kinsell ..... B64D 13/06 138/32
4,429,830 A * 2/1984 Forster et al. ..... 237/19
4,512,148 A * 4/1985 Jacobson ..... F01N 3/046 285/136.1
4,550,711 A * 11/1985 Griffiths ..... A47J 37/12 126/343.5 A
4,556,105 A * 12/1985 Boner ..... F28D 9/0037 165/164
4,708,199 A * 11/1987 Yogo ..... F28D 9/0012 165/167
4,754,779 A * 7/1988 Juhasz ..... 137/340
4,784,213 A * 11/1988 Eager et al. ..... 165/101
4,815,534 A * 3/1989 Fuerschbach ..... F28D 9/0075 165/166
4,818,842 A * 4/1989 Walty ..... F02M 31/125 123/549
4,881,380 A * 11/1989 Mrugala et al. ..... 165/145
4,956,626 A * 9/1990 Hoppe ..... H01F 27/085 165/179
5,058,511 A * 10/1991 Loevinger ..... B61D 5/04 105/358
5,069,276 A * 12/1991 Seidel ..... F28D 9/0037 165/166
5,115,491 A * 5/1992 Perlman et al. ..... 165/103
5,165,468 A * 11/1992 Tajima ..... B60K 11/04 165/167
5,307,869 A * 5/1994 Blomgren ..... F28D 9/005 165/153
5,320,161 A * 6/1994 Iiams ..... 165/61
5,368,786 A * 11/1994 Dinauer ..... B01D 53/268 128/203.12
5,403,564 A * 4/1995 Katschnig et al. ..... 422/307
5,417,274 A * 5/1995 Verkaart ..... 165/103
5,464,056 A * 11/1995 Tajima ..... F28D 9/0012 123/196 AB
5,469,914 A * 11/1995 Davison ..... F28D 9/0037 165/165
5,492,171 A * 2/1996 Kallrot ..... F28D 9/005 165/144
5,787,977 A * 8/1998 Yuasa ..... F28D 9/0012 165/165
5,823,247 A * 10/1998 Weibler ..... F28D 9/0037 165/166
5,863,580 A * 1/1999 Reznik ..... 426/237
5,881,763 A * 3/1999 Angelos ..... 137/340
5,964,280 A * 10/1999 Wehrmann ..... F28D 9/005 165/140
5,964,283 A * 10/1999 Pavlin ..... F28D 9/005 123/196 AB
5,983,922 A * 11/1999 Laing et al. ..... 137/340
6,026,844 A * 2/2000 Laing et al. ..... 137/340
6,032,869 A * 3/2000 Ito et al. ..... 165/103
6,158,238 A * 12/2000 Lampinen ..... F25B 15/06 165/140
6,173,681 B1 * 1/2001 Pope ..... 122/451.1
6,182,748 B1 * 2/2001 Brost ..... F02M 31/20 123/196 AB
6,196,246 B1 * 3/2001 Folsom ..... 137/340
6,294,135 B1 * 9/2001 Joo et al. ..... 422/173
6,341,650 B2 * 1/2002 Carpentier ..... 165/157
6,364,007 B1 * 4/2002 Fischer ..... F28D 9/0037 165/155
6,367,703 B1 * 4/2002 Morosas ..... 237/55
6,415,858 B1 * 7/2002 Getchel et al. ..... 165/101
6,749,014 B2 * 6/2004 Ferraro ..... 165/47
6,802,368 B2 * 10/2004 Getchel et al. ..... 165/101
6,827,091 B2 * 12/2004 Harrison ..... 165/95
6,835,307 B2 * 12/2004 Talbert et al. ..... 165/200
6,935,361 B2 * 8/2005 Rocheleau ..... 137/340
7,178,581 B2 * 2/2007 St. Pierre ..... F28D 9/0012 165/167
7,219,720 B2 * 5/2007 Wakita ..... B23P 15/26 165/153
7,306,030 B2 * 12/2007 Luvisotto ..... F16K 15/16 137/454.2
7,533,717 B2 * 5/2009 Hummel ..... F28D 9/005 165/167
7,566,430 B2 * 7/2009 Katschnig et al. ..... 422/307
7,766,077 B2 * 8/2010 Masters et al. ..... 165/200
7,866,380 B2 * 1/2011 Masters et al. ..... 165/200
7,959,814 B2 * 6/2011 Masters et al. ..... 165/200
8,495,893 B2 * 7/2013 Alajimi ..... 62/389
8,678,706 B2 * 3/2014 Luciano, Jr. ..... 137/340
9,268,342 B2 * 2/2016 Beyerle ..... G05D 23/1346
9,341,390 B2 * 5/2016 van der Heijden ..... F24H 1/185
2001/0032714 A1 * 10/2001 Haglid ..... F24F 5/0035 165/54
2002/0060065 A1 * 5/2002 Ferraro ..... 165/47
2003/0223909 A1 * 12/2003 Oberbeck ..... B01F 5/0604 422/606
2004/0112579 A1 * 6/2004 Strahle ..... F28D 9/005 165/166
2004/0206485 A1 * 10/2004 Ferraro ..... 165/156
2004/0226692 A1 * 11/2004 Lagerstrom ..... F28D 9/0037 165/81
2005/0155749 A1 * 7/2005 Memory ..... F28D 9/0075 165/167
2005/0194123 A1 * 9/2005 Strahle ..... F28D 9/0012 165/167
2007/0158048 A1 * 7/2007 Ferraro ..... 165/47
2007/0215331 A1 * 9/2007 Higashiyama ..... F25B 39/022 165/167
2007/0251671 A1 * 11/2007 Barnes ..... F28D 1/0333 165/83
2008/0314572 A1 * 12/2008 Hommes ..... F01M 5/002 165/166
2009/0101309 A1 * 4/2009 Strelow ..... 165/103
2009/0178717 A1 * 7/2009 Mirchildon ..... 137/80
2010/0025028 A1 * 2/2010 Shinhama ..... F25B 39/04 165/174
2010/0032148 A1 * 2/2010 Bermhult ..... F28D 9/0043 165/166
2010/0059215 A1 * 3/2010 Kolb ..... F28D 1/0341 165/152
2010/0241073 A1 9/2010 Andersen et al.
2010/0300651 A1 * 12/2010 Kumar ..... F28D 9/005 165/70
2011/0024082 A1 * 2/2011 Bharne ..... F28D 9/0012 165/95
2011/0024095 A1 * 2/2011 Kozdras ..... F28D 9/005 165/167
2012/0061048 A1 * 3/2012 Ohi ..... F01M 5/002 165/51
2012/0234523 A1 * 9/2012 Jouanny ..... F28D 9/005 165/166
2013/0061584 A1 * 3/2013 Gerges ..... F01N 5/02 60/320
2013/0126149 A1 * 5/2013 Kim ..... F01P 3/18 165/297
2013/0244077 A1 * 9/2013 Palanchon ..... F28F 3/12 429/120

(56) References Cited

U.S. PATENT DOCUMENTS

| | | | | |
|---|---|---|---|---|
| 2013/0248157 | A1* | 9/2013 | Zheng | C23C 18/1616 165/133 |
| 2013/0284412 | A1* | 10/2013 | Forstenius | F16B 43/00 165/166 |
| 2014/0260369 | A1* | 9/2014 | Lepoudre | F28D 5/02 62/91 |
| 2014/0352934 | A1* | 12/2014 | Barone | B23P 15/26 165/166 |
| 2015/0168075 | A1* | 6/2015 | Bertilsson | B21J 5/066 165/166 |
| 2015/0211810 | A1* | 7/2015 | Meguriya | F28F 3/08 165/166 |
| 2015/0369517 | A1* | 12/2015 | Bourgault | F24H 1/208 122/15.1 |
| 2016/0003560 | A1* | 1/2016 | Van Ballekom | F28F 27/02 165/101 |
| 2016/0010929 | A1* | 1/2016 | Takahashi | F28F 3/027 165/166 |
| 2016/0033211 | A1* | 2/2016 | Choi | F28F 9/0256 165/297 |

FOREIGN PATENT DOCUMENTS

| | | | |
|---|---|---|---|
| DE | 10115136 | A1 | 10/2002 |
| DE | 10222466 | A1 | 12/2003 |
| DE | 10348687 | B3 | 4/2005 |
| DE | 202006009322 | U1 | 8/2006 |
| DE | 202009009218 | U1 | 9/2009 |
| DE | 102008016793 | A1 | 10/2009 |
| EP | 0519615 | A1 | 12/1992 |
| EP | 0953815 | A2 | 11/1999 |
| EP | 1528329 | A1 | 5/2005 |
| EP | 1528330 | A1 | 5/2005 |
| EP | 1544532 | A1 | 6/2005 |
| EP | 1867944 | A2 | 12/2007 |
| EP | 1884723 | A1 | 2/2008 |
| GB | 824021 | A | 11/1959 |
| GB | 2438248 | A | 11/2007 |
| WO | 9708506 | A1 | 3/1997 |
| WO | 9715798 | A1 | 5/1997 |
| WO | 9837373 | A1 | 8/1998 |
| WO | 0111301 | A1 | 2/2001 |

* cited by examiner

HEAT EXCHANGER UNIT HAVING CONNECTORS WITH IDENTICAL BASE ELEMENTS

The invention relates to a heat exchanger unit, in particular a heat exchanger unit for the heating of service water in a heating installation.

Heat exchanger units are used, for example, in heating installations to heat service water, i.e. drinking water, with the aid of the heating medium circulating within the heating installation, preferably also water. Such heat exchangers are generally formed as plate heat exchangers and comprise four connection points: an inlet for the heating medium, an outlet for the heating medium, an inlet for the service water, and an outlet for the service water. These connection points have to be connected to further hydraulic components and the heating installation, for which purpose different connection elements are required. Furthermore, the assembly process, i.e. the connection of the different system parts, can be quite complex and expensive.

The object of the invention is to provide a heat exchanger unit which can be easily integrated, as a pre-assembled unit, into a heating installation and which can be produced in a cost-effective manner.

This object is achieved by a heat exchanger unit, in particular to be used for the heating of service water in a heating installation, having the features disclosed in claim 1. Preferred embodiments will emerge from the dependent claims, the description below and the accompanying drawings.

In accordance with the invention the heat exchanger unit according to the invention is particularly provided for the heating of service water in a heating installation, i.e. it may preferably be a service water heating unit of a heating installation. Such a service water heating unit can comprise all essential components necessary for the heating of service water and can thus form a pre-assembled unit which can then be easily integrated in a heating installation or a building. Merely connections from the service water heating unit to the heating installation and, if necessary, the pipelines of the building then also have to be produced. In particular, such a service water heating unit contains a heat exchanger having the necessary connection points and a circulating pump for conveying heating medium to the heat exchanger. Furthermore, sensors, any valves which are necessary and, in particular, a control device for controlling the heating of service water can also be integrated in the service water heating unit so that it ideally only has to be connected to the external pipelines and to a power supply via its line connections. The line connections contain, in particular, an inlet and outlet for heating medium, an inlet and outlet for service water to be heated, and optionally a connection point for a service water circulation line.

The heat exchanger unit according to the invention comprises a heat exchanger which is formed as plate heat exchanger. Plate heat exchangers can be produced in a cost-effective manner, have large heat transfer areas, internally, between the two media, and can be designed so as to be inherently stable, such that they can be used as a bearing element of the heat exchanger unit, on which further system components can be mounted. A separate bearing structure can thus be omitted.

In order to connect the heat exchanger to further system parts, a first connector is provided which is mounted on a first fluid connection point of the heat exchanger. This fluid connection point is one of the four above-mentioned connection points of the heat exchanger, i.e. inlet or outlet for the heating medium, or inlet or outlet for the medium to be heated, in particular service water. Within the meaning of the invention, the term "connector" is to be understood to be an element which can produce a connection between external system parts and the heat exchanger, in particular a fluid connection to at least one of the fluid connection points of the heat exchanger. The connector fitting does not necessarily have to include valves or the like.

In addition to the first connector, a second connector is further provided in accordance with the invention and is likewise mounted on or fastened to the heat exchanger. This second connector does not necessarily have to produce a connection to one of the fluid connection points of the heat exchanger, i.e. this second connector does not necessarily connect further system parts to the heat exchanger in a hydraulic manner, but may merely fasten further system parts to the heat exchanger in a mechanical manner.

In accordance with the invention, in order to reduce the variety of parts and therefore enable cost-effective production of the heat exchanger unit, the first and second connectors each comprise at least one identical base element which defines, internally, at least one flow duct. The number of individual parts required is reduced since the same base element can be used in two different connectors on the heat exchanger. Internally, the base element comprises a flow duct, wherein this does not necessarily also have to be used in the connectors, but instead such a flow duct may also remain unused, for example in the second connector, for example if this is only used for the mechanical fastening of further components. In the first connector, this flow duct is preferably connected to a first fluid connection of the heat exchanger.

The first fluid connection point is preferably arranged on a first side of the heat exchanger and the second connector is arranged on a second side, in particular opposite the first side, of the heat exchanger. The two opposed sides of the heat exchanger on which the connectors are preferably arranged are preferably the planar side faces of the heat exchanger which extend parallel to the plates separating the flow paths inside the heat exchanger. This means, the connectors are mounted on two opposite side faces of the plate stack. These side faces are normally planar surfaces on which the further elements can be mounted effectively. The plate stack can thus be inserted easily into a surrounding, basically tubular housing from the open sides, end plates closing the open sides of the housing. The connectors may be arranged on these end plates. The housing preferably comprises four side faces arranged at right angles to one another, but may also be shaped in accordance with the shape of the plates in the heat exchanger. Owing to the arrangement of the connectors on two sides of the heat exchanger, the heat exchanger forms the bearing element between the connectors and holds together the entire heat exchanger unit, preferably without external bearing structures.

More preferably, at least one connector may comprise an additional connection part connected to the base element, which connection part comprises, internally, a flow duct which is preferably connected to at least one flow duct in the base element. Such a connection part makes it possible to manufacture the base element in a simple manner since said base element can therefore have a less complex shape and is only completed by the additional connection part once it has been shaped. This is advantageous in particular if the connectors and the base elements thereof are made of plastics material by injection moulding. Furthermore, it is possible to provide different functions in two connectors, despite the identical base element, by placing a further connection part on the base element in at least one connector. The connection part defines a further flow path through the flow duct formed internally, it being possible for this to be used to connect or fasten further hydraulic components. This flow duct inside the connection part may be connected to a flow duct in the base element, but may also be formed separately depending on the hydraulic requirements. The connection between base element and connection part is preferably formed by a plug connection, a seal possibly being required between the connection part and base element with connection of the flow ducts.

More preferably, at least one second fluid connection point is provided on the heat exchanger and is connected to the second connector, the first fluid connection point preferably being arranged on a first side of the heat exchanger and the second fluid connection point preferably being arranged on a second side of the heat exchanger. This is preferably a side facing away from the first side. As described above, all fluid connection points are preferably arranged on the end faces of the plate stack of the heat exchanger, these extending parallel to the plates inside the heat exchanger. By arranging the second connector or the base element thereof on the second fluid connection point, the second connector is thus used to hydraulically connect the second fluid connection point of the heat exchanger to external component parts and lines. For this purpose, the at least one flow duct inside the base element of the second connector is preferably connected to the second fluid connection point of the second heat exchanger.

In accordance with a further preferred embodiment, the identical base elements of the first and second connectors each comprise, internally, at least two separate flow ducts, wherein in the first connector a first of the two flow ducts is connected to the first fluid connection point, and in the second connector comprising an identical base element at least a second of the two flow ducts is connected to the second fluid connection point. That means, when using the same base element in the first and second connectors, different flow ducts are used in each case to connect the first fluid connection point and the second fluid connection point of the heat exchanger to external lines and components. If the first and second connectors are arranged on opposite end faces of the heat exchanger, the base element of the second connector is preferably rotated through 180° compared to the base element of the first connector, such that identical side faces of the base elements are opposed, preferably the side faces which comprise connection openings for connection to the fluid connection points of the heat exchanger.

In the second connector, the second of the two flow ducts in the base element is preferably connected to the second fluid connection point, whereas the first of the two flow ducts in the base element is connected to a third fluid connection point of the heat exchanger, which third fluid connection point is preferably located on the same side of the heat exchanger as the second fluid connection point. That means, in the second connector the base element with its two separate flow ducts is used to connect two fluid connection points of the heat exchange to external components. A simple hydraulic connection between the heat exchanger and two fluid connection points is thus achieved with a single component part. For example, these two fluid connection points may be the outlet for the heating medium and a cold water inlet for the service water to be heated. The first fluid connection point of the heat exchanger, which is connected to the base element of the first connector, may preferably be the outlet for the heated fluid, in particular for heated service water.

The flow duct in the base element of the first and second base connectors preferably branches from a connection opening facing the respective fluid connection point of the heat exchanger into two line connections. That means, this flow duct is basically T-shaped and has a point of intersection, from which three portions of the flow duct extend towards three line connections which are thus interconnected. A first of the line connections is preferably closed at the first connector and a second of the line connections is preferably closed at the second connector. For example, this may be achieved by a removable closure element, such as a stopper, or else by an applied connection part which simultaneously closes the corresponding line connection. A seal may optionally also be arranged between the applied element and the line connection for sealing. Further, it is also possible to close a line connection by an adjacent wall of the heat exchanger, possibly with an intermediate seal, such that an additional closure element for closing the line connection can be omitted. By closing individual line connections on the base element, it is possible to use the same base element in the first and second connectors differently, i.e. differently guided flow paths may be formed in the first and second connectors so that external component parts or pipelines are placed on different sides of the base element or respective connector and can be connected to the flow duct inside the base element. Versatile connection options are thus provided, even with a minimal variety of parts.

In accordance with a specific embodiment, one of the two line connections can be closed by a connection part which defines, internally, a flow duct which is not connected to the line connection to be closed. That means, even if the connection part likewise has a flow duct in its interior, this down not necessarily have to be connected to the flow duct in the base element, on which this connection part is placed, but instead the connection part can simultaneously close the line connection of a flow duct in the base element.

It is further preferred for a holder for a sensor, in particular for a temperature and/or flow rate sensor, to be formed in the first and second connectors in at least one flow duct or flow path of the base element. The sensor may thus also be a combined temperature and flow rate sensor. These sensors are used to control or regulate the operation of the heat exchanger unit, in particular in order to control or regulate the feed of heating medium as required. Since an appropriate holder for such sensors is provided in the connectors or the base elements thereof, these sensors can be inserted very easily into the heat exchanger unit at low assembly cost. Even if a holder for such a sensor is provided in each of the base elements of the first and second connectors, since these base elements are identical, this does not necessarily mean that a sensor is also placed in these holders. It is also conceivable that a sensor in the respective flow duct is only used in one of the connectors, whilst in the other connector the holder remains unused, possibly closed by a closure element.

More preferably, a third connector is arranged on the heat exchanger, preferably on the side of the first fluid connection point, and is connected to a fourth fluid connection point of the heat exchanger. Such a fourth fluid connection point may be, for example, the inlet for heating medium into the heat exchanger. The fourth fluid connection point is preferably distanced from the first fluid connection point, but is preferably arranged on the same side or side face of the heat exchanger. The first and third connectors may this be distanced from one another on the same side of the heat exchanger, in such a way that a circulating pump, for example, can be arranged between two further component parts. The third connector may preferably comprise a base element which is different from the base element of the first and second base fittings, but may also comprise an identical base element if necessary.

The third connector more preferably fastens and connects a circulating pump, wherein a flow duct inside the third connector connects a first connection point of the circulating pump, for example the pressure connection, to the fourth fluid connection point of the heat exchanger. For example, the circulating pump may thus be used to convey heating medium into the heat exchanger or through a first flow path of the heat exchanger in order to heat a liquid therewith, for example service water, in a second flow path of the heat exchanger.

The circulating pump is furthermore preferably connected via its second connection point, for example the intake connection, to the first connector, the circulating pump more preferably being connected to a second flow duct of the first connector, which second flow duct is not directly connected to a fluid connection point of the heat exchanger and forms a connection to a line connection of the connector. This flow duct is preferably a flow duct formed in the base element of the first connector. It therefore does not directly connect a fluid connection point of the heat exchanger, but merely connects the circulating pump in order to create a connection between external system components, for example pipelines, and the circulating pump.

The first and second connectors are particularly preferably designed with applied connection parts where necessary, in such a way that they produce all necessary line connections of the heat exchanger unit on one side, more preferably in a plane of the heat exchanger unit. The connection point of the heat exchanger unit to external components and pipelines is thus simplified, since an interface is provided on the heat exchanger unit, on which are arranged all line connections to be connected. The heat exchanger unit thus preferably comprises at least four line connections to the connectors: for the inlet and outlet of the heating medium and for the inlet and outlet of the medium to be heated, in particular service water. Further connection points may be provided if necessary, for example a connection point for a circulation line.

The second flow duct in the first connector preferably comprises a connection opening facing the heat exchanger, which connection opening is closed in the first connector. The connection opening is preferably formed in the base element and is particularly preferably closed by the side wall of the heat exchanger facing this connection opening, it being possible for a seal to be arranged between the side wall and the base element. The opening can thus be closed very easily by assembling the connector on the heat exchanger. The remaining portions of the second flow duct merely connect the two remaining line connections of the flow duct and serve as a connection line for the connected circulating pump. At the same time, a connection opening of the first flow duct in the base element in the first connector is preferably connected to a fluid connection point of the heat exchanger. The connection opening of the first flow duct and the connection opening of the second flow duct preferably lie side by side in a plane, in such a way that they can be connected either simultaneously to two fluid connection points in a side wall of the heat exchanger, or, if there is no fluid connection point at the respective place, can rest in a sealed manner against the side face of the heat exchanger.

In accordance with a further preferred embodiment, a fourth connector is provided on the heat exchanger and is preferably fastened, or can be fastened to the second connector. The fourth connector preferably comprises a base element which is identical to at least a base element of the third connector. The base element of the third connector can thus fulfil a dual function, i.e. can be used in an identical manner as a base element of the fourth connector. This connector is preferably located on the same side of the heat exchanger as the second connector, preferably at a distance therefrom. The first and second connectors are preferably arranged, as described, on opposite end faces of the heat exchanger, but more preferably on the same side edge of the heat exchanger, the third and fourth connectors accordingly preferably being located on an opposite side edge. For example, the first and second connectors are arranged in the vicinity of the upper face of the heat exchanger, and the third and fourth connectors are arranged in the vicinity of the underside of the heat exchanger, in each case on opposite end faces of the heat exchanger.

The fourth connector is preferably not directly connected to a fluid connection point of the heat exchanger. It thus merely fastens further component parts on the heat exchanger in a mechanical manner and does not produce a hydraulic connection to one of the fluid connection points of the heat exchanger.

The fourth connector preferably connects and fastens a second circulating pump to the heat exchanger. For example, this second circulating pump may be a circulation pump for the circulation of service water. It is possible that this second circulating pump can optionally be mounted on the heat exchanger, it then preferably being possible to also optionally fasten the fourth connector to the heat exchanger. This means that the fourth connector is mounted on the heat exchanger if the second circulating pump is to be fastened. The fourth connector does not directly produce a fluid connection from the circulating pump to a fluid connection point of the heat exchanger, but, if necessary, merely fastens the circulating pump to the heat exchanger in a mechanical manner.

The second circulating pump is thus preferably fastened, or can be fastened between the second and fourth connectors, a flow duct in the second connector or in the base element of the second connector preferably forming a fluid connection, from the second circulating pump to a fluid connection point of the heat exchanger. For example, this fluid connection of the heat exchanger is the service water inlet. This second circulating pump, when used as a circulation pump, can thus feed service water back to the service water inlet of the heat exchanger. In this regard the intake connection of the circulating pump is preferably connected to a line connection of a flow duct of the second connector. This flow duct does not have to be formed directly in the base element of the second connector, but can also be a flow duct which is formed in a connection part which is placed on the base element of the second connector. This flow duct preferably merely produces a connection to a line connection on one side of the heat exchanger unit, at which an external circulation line can then be connected to the heat exchanger unit. As described above, the line connection preferably lies on a side or in a plane with the other line connections for connection of the heat exchanger unit to external components, such as pipelines. More preferably, the second connection of the circulating pump, preferably the pressure connection, is likewise connected to a flow duct in the second connector via a pipeline. The pipeline for connecting the second circulating pump to the second connector is preferably held on the fourth connector, it being possible to guide the flow path in this pipeline through a flow duct in the fourth connector. This flow duct may be formed in a base element of the fourth connector, which is identical to the base element of the third connector, or else in an additional connection part connected to the base element. The pipeline preferably leads to a line connection of one of the flow ducts in the base element of the second connector. This is a flow duct which is branched in a T-shape and comprises a second line connection which is preferably used to connect a cold water line. This flow duct leads from the two line connections to a connection opening which is connected to a fluid connection point of the heat exchanger. This fluid connection point is preferably the inlet for the service water to be heated. In this manner, both cold service water to be heated and the circulated service water can be fed back to the inlet of the heat exchanger.

Figure 2:
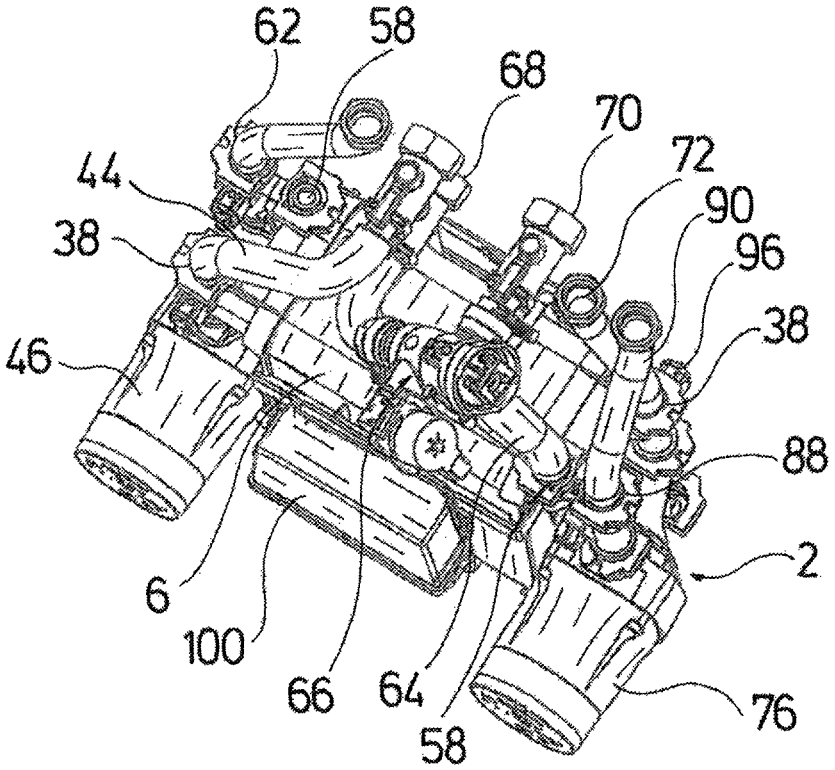

The heat exchanger unit according to the invention will be described hereinafter by way of example with reference to a service water heating unit which represents such a heat exchanger unit. In the drawings:

FIG. 1 shows an overall view of a service water heating unit arranged on a heat accumulator, FIG. 2 shows a perspective overall view of the service water heating unit according to FIG. 1.

Figure 3:
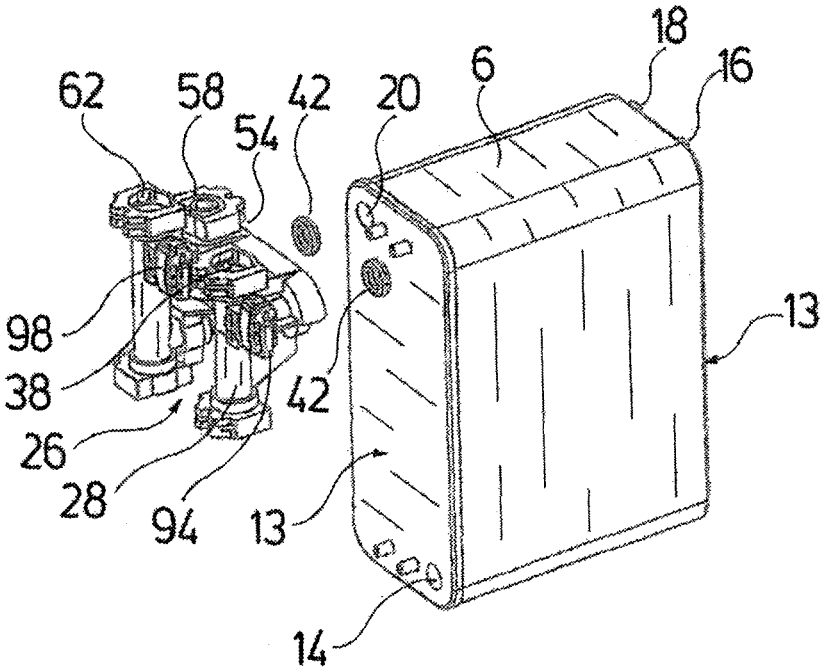
Figure 4:
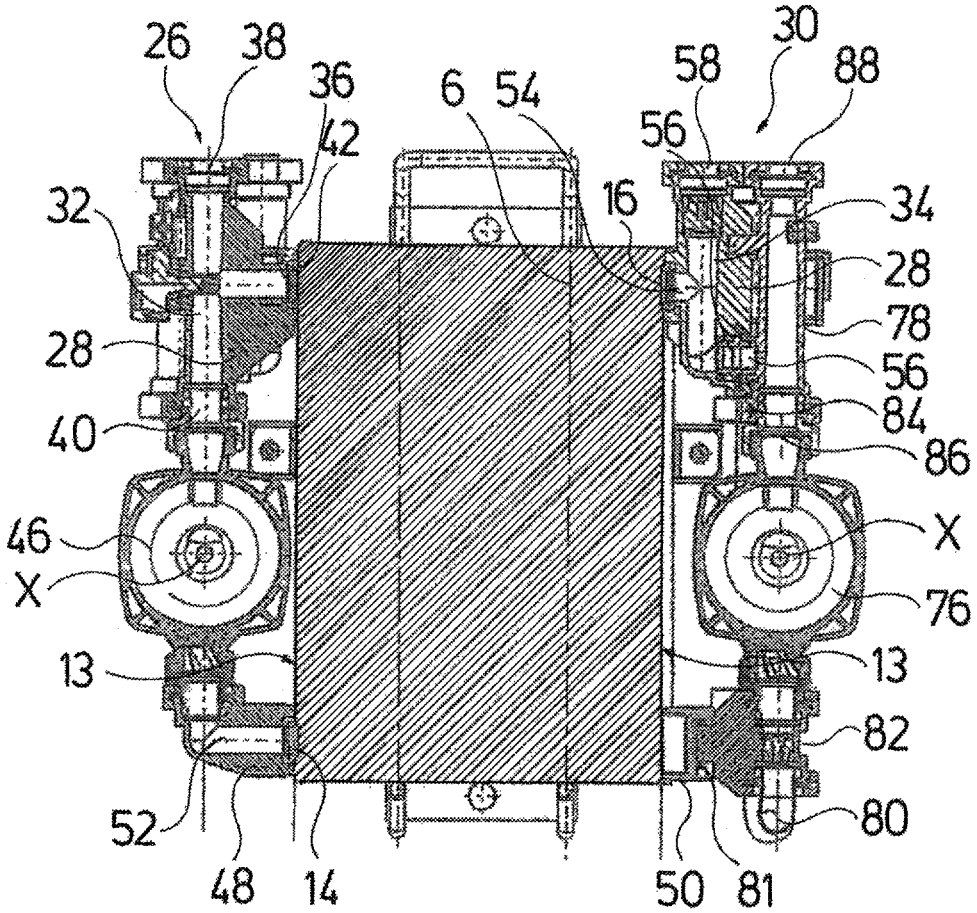
Figure 5:
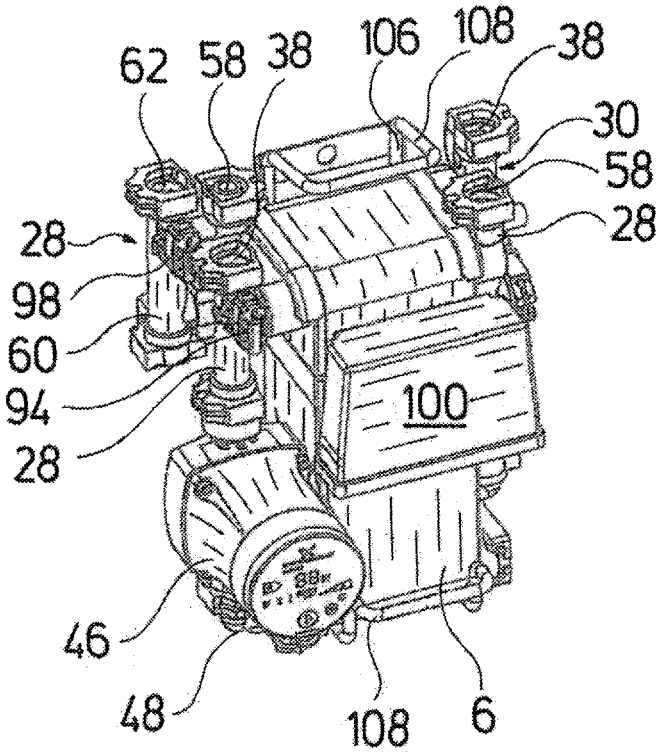
Figure 6:
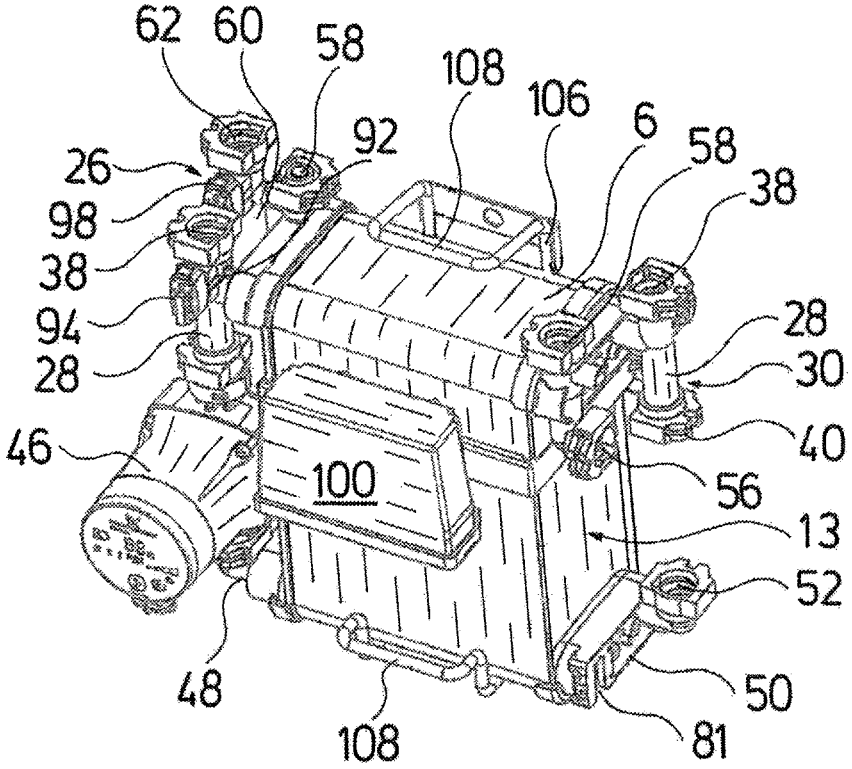
Figure 7:
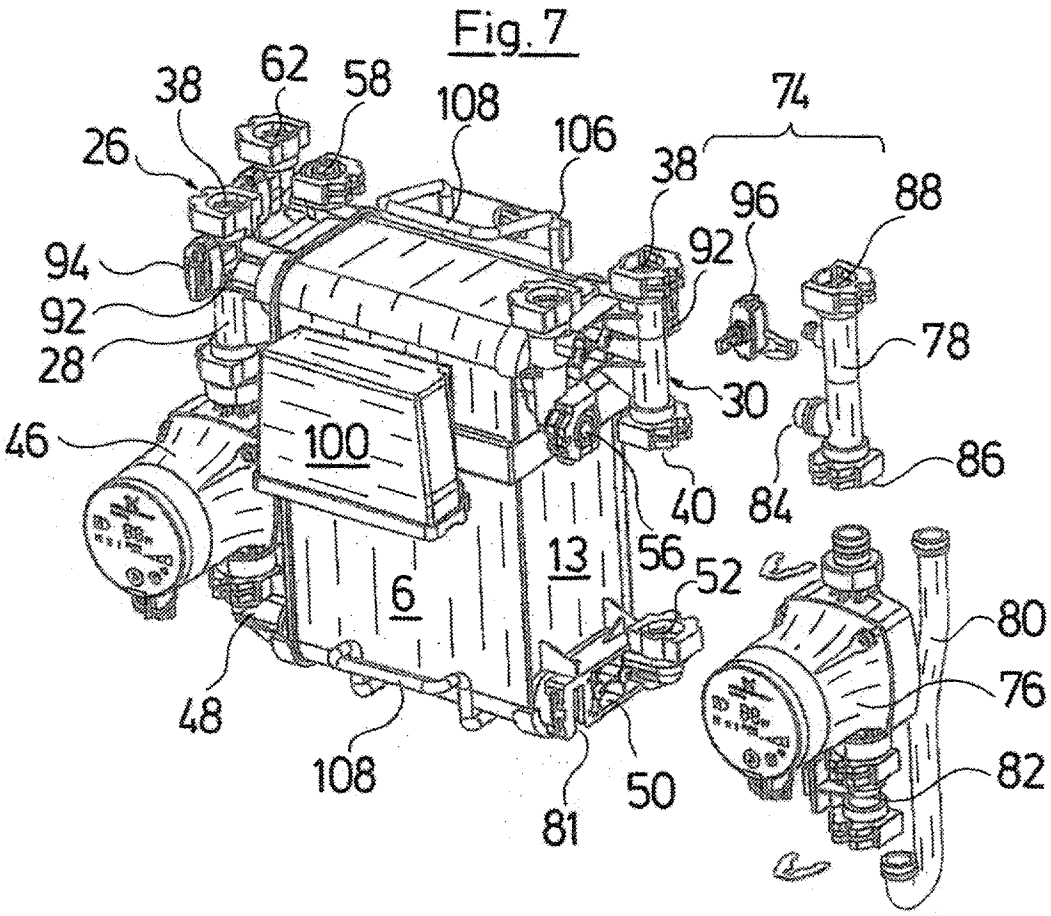
Figure 8:
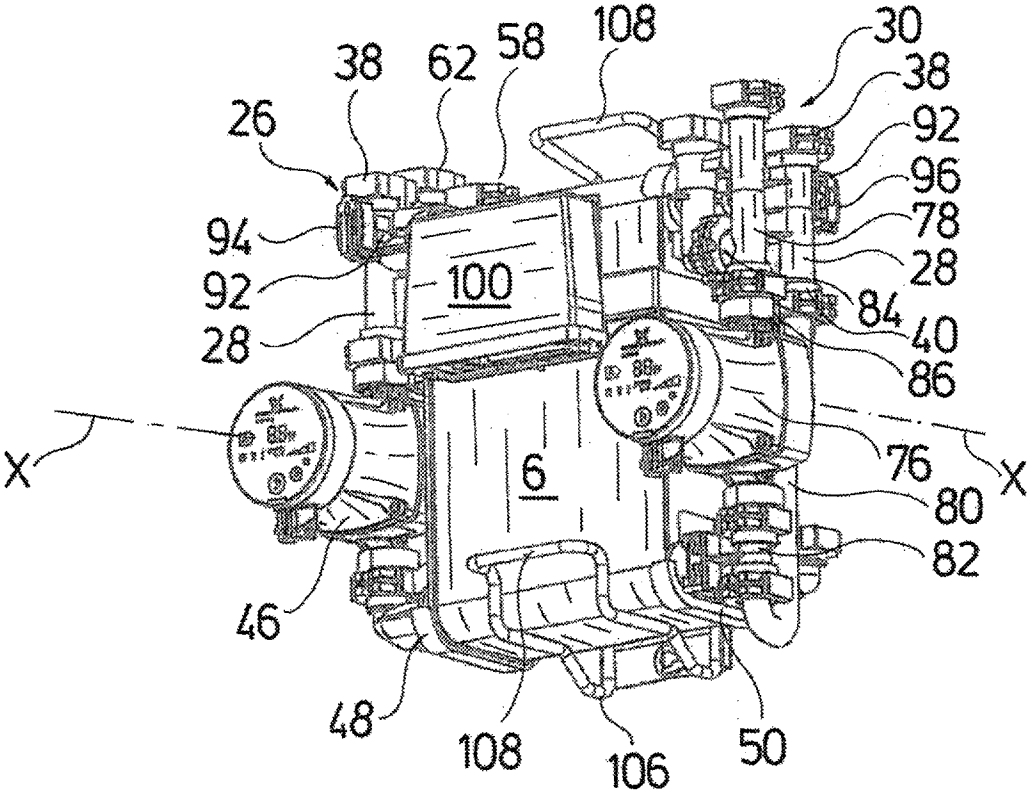
Figure 9:
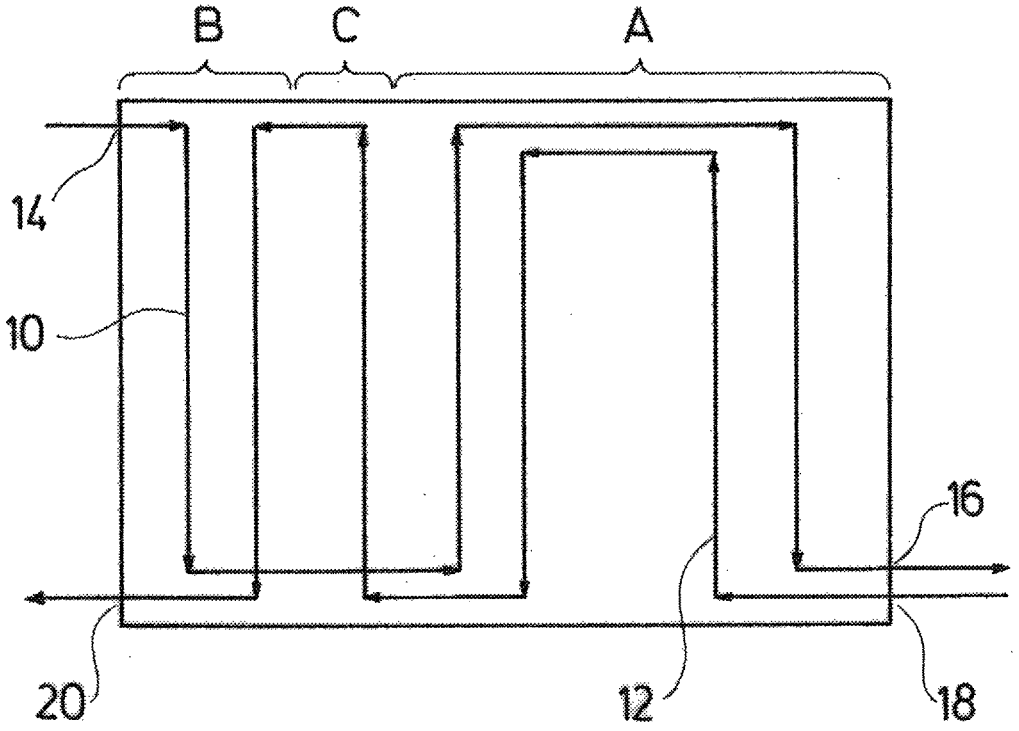
Figure 10:
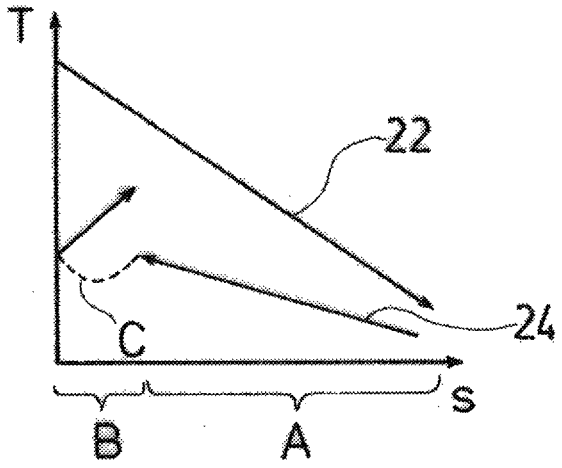
Figure 11:
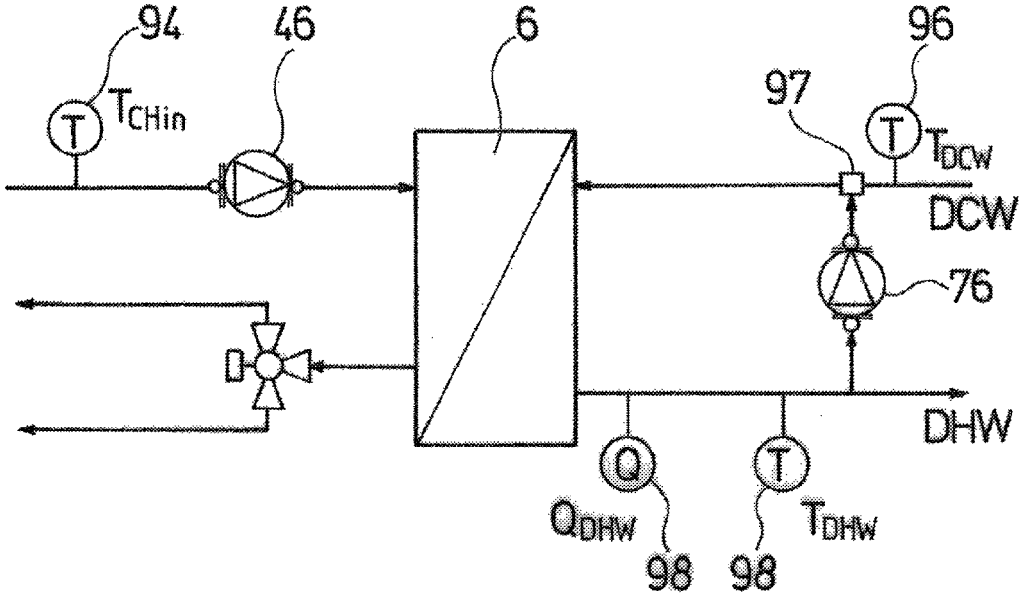
Figure 12:
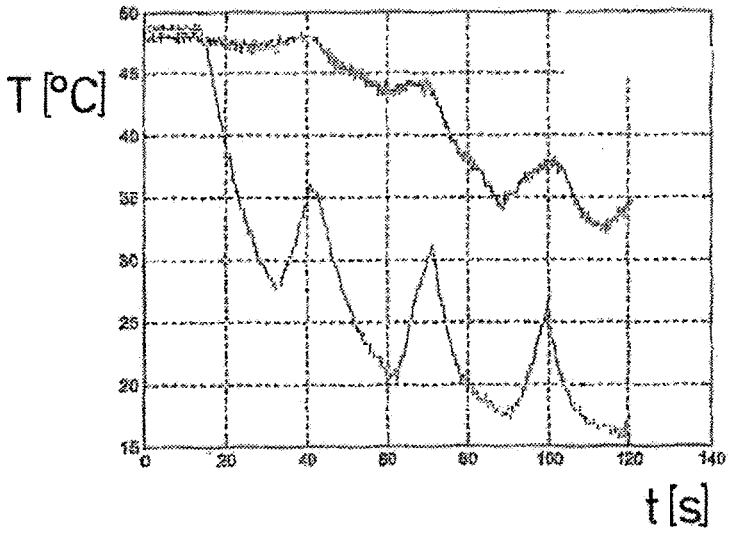
Figure 13:
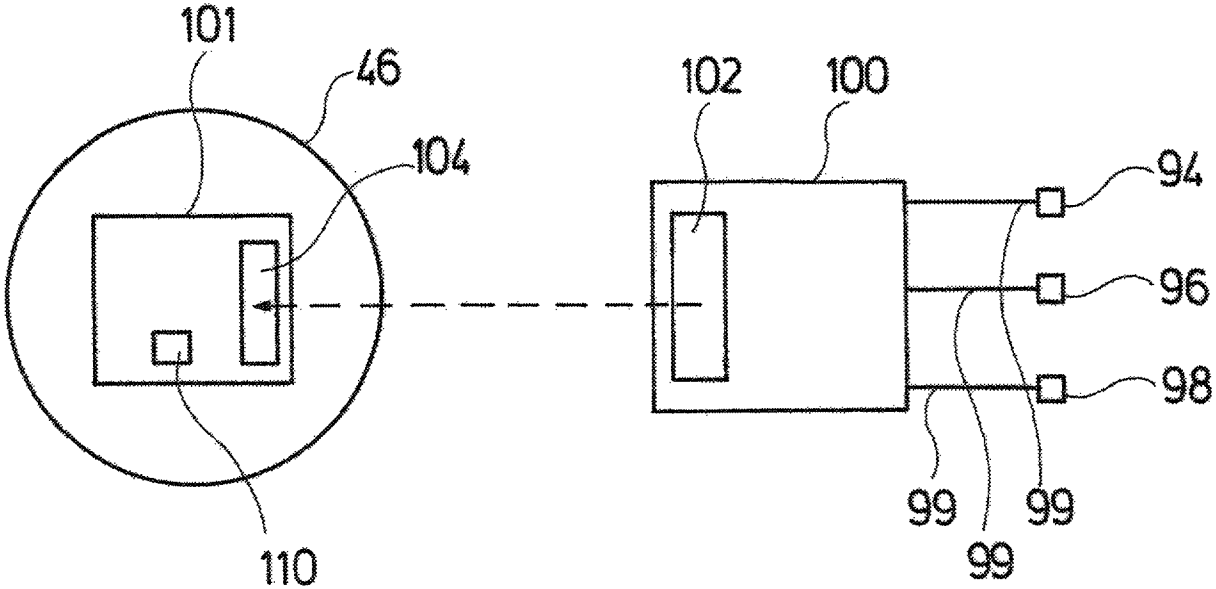
Figure 14:
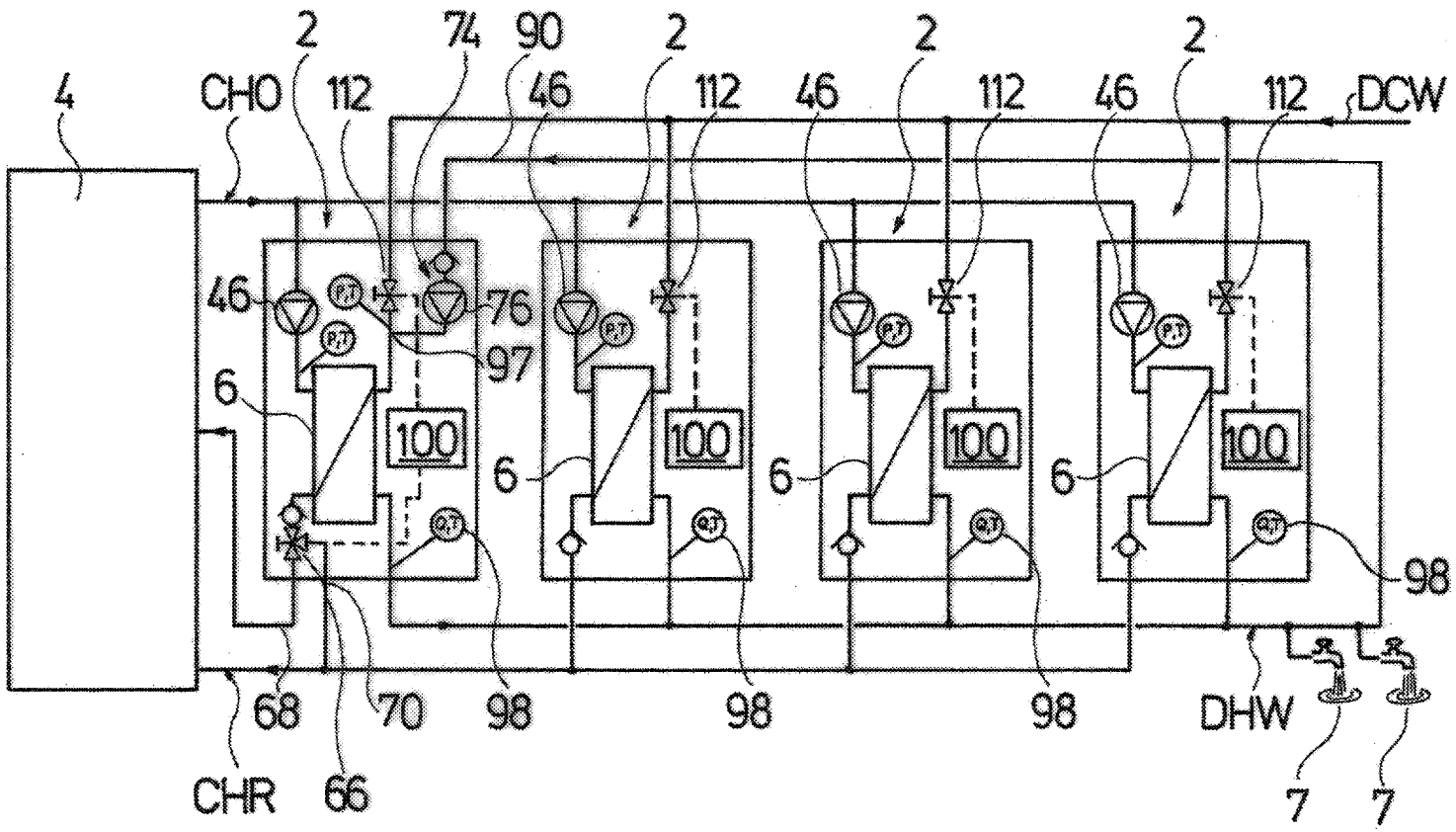
Figure 15:
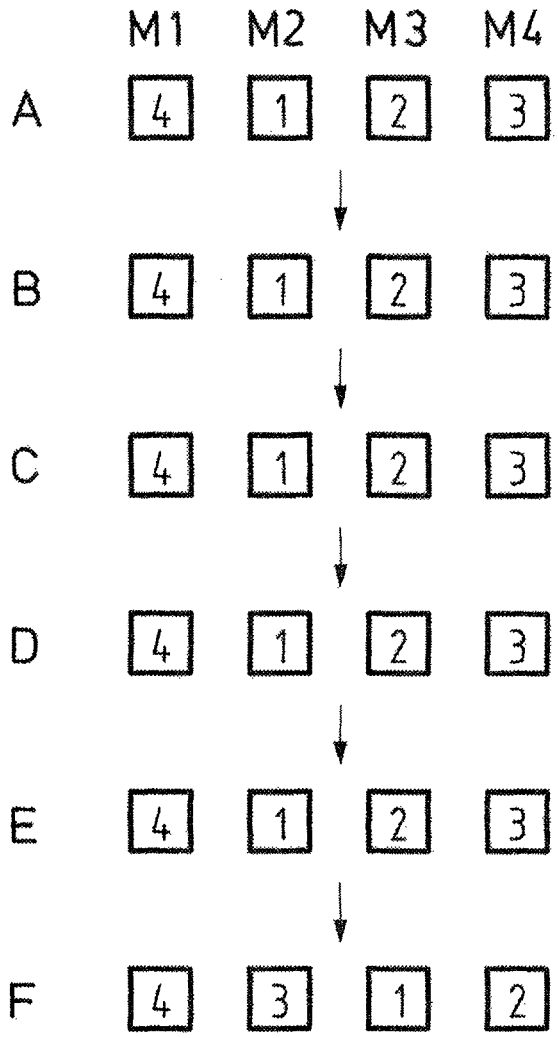
Figure 16:
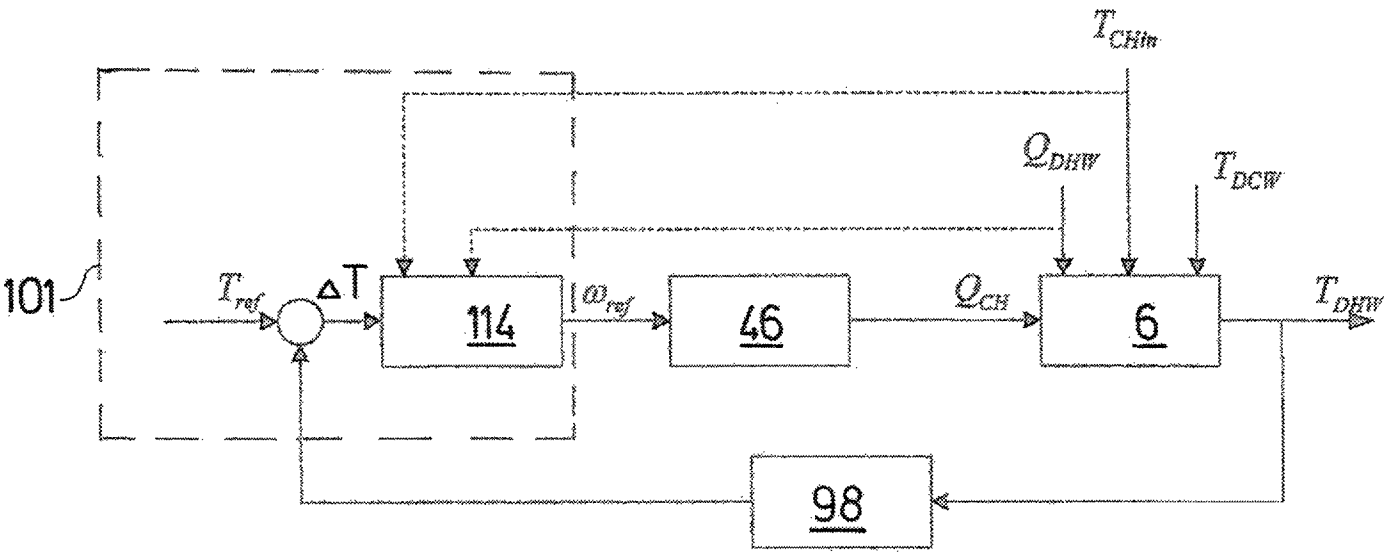

FIG. 3 shows a perspective view of the heat exchanger comprising a connector, FIG. 4 shows a sectional view of the service water heating unit according to FIG. 2, FIGS. 5 and 6 show a service water heating unit according to FIGS. 1, 2 and 4 without a service water circulation module, FIG. 7 shows a perspective exploded view of the service water heating unit with a service water circulation module, FIG. 8 shows a perspective view of the service water heating unit with an assembled service water circulation module, FIG. 9 shows a schematic view of the flow paths inside the heat exchanger according to FIG. 3, FIG. 10 shows the temperature curve inside the heat exchanger over the flow path, FIG. 11 shows a hydraulic circuit diagram of a service water heating unit, FIG. 12 shows the temperature curve which is detected by a temperature sensor in the cold water inlet of the service water heating unit, FIG. 13 shows a schematic view of the data transfer from the sensors to a control device, FIG. 14 shows the arrangement of a plurality of service water heating units 2 in a cascade arrangement, FIG. 15 shows a schematic view of the control of the plurality of service water heating units according to FIG. 14, and FIG. 16 shows a schematic view of a control circuit for controlling the service water heating units.

The heat exchanger unit shown as an example is a service water heating unit 2 and is provided for use in a heating installation. In the example shown here (FIG. 1), the service water heating unit 2 is mounted on a heat accumulator 4, for example a water store, which stores heating water heated by a solar installation. The heat exchanger 6 of the service water heating unit 2 is supplied with heating medium from the heat accumulator 4 to heat service water. In FIG. 1 a housing surrounding the service water heating unit 2 is illustrated in the open position, i.e. the front cover is removed. In the other figures the service water heating unit 2 is illustrated without a surrounding housing.

The central component of the heat exchanger unit or service water heating unit 2 is a heat exchanger 6 in the form of a plate heat exchanger. Service water to be heated is heated via the heat exchanger 6 and discharged as heated service water, for example in order to supply tap points 7 of wash basins, showers, bathtubs, etc. in a house with hot service water. The heat exchanger is supplied with heating medium in order to heat the service water. Said heat exchanger is provided, internally, with two flow paths, as illustrated schematically in FIG. 9. A first flow path 10 is the flow path through which the heating medium is guided through the heat exchanger. The second flow path 12 is the flow path through which the service water is conveyed through the heat exchanger. Both flow paths are separated from one another in a manner known per se by plates, via which a heat transfer from the heating medium to the service water is possible.

The two outer plates 13 of the plate stack form two mutually opposed side faces of the heat exchanger 6. The fluid connection points 14 to 20 of the heat exchanger 6 are formed on these side faces and connectors are fastened there, as described below.

The heating medium passes through the inlet 14 into the heat exchanger 6 and exits again through the outlet 16. The service water to be heated enters into the heat exchanger 6 at the inlet 18 and exits again from the heat exchanger at the outlet 20. As is shown schematically in FIG. 9, the heat exchanger is divided into three portions A, B and C. In the direction of flow of the service water through the second flow path 12, portion A forms a first portion in which the first flow path 10 and the second flow path 12 pass by one another in countercurrent. This means, the service water to be heated and the heating medium flow in opposite directions past the plates of the heat exchanger separating them. The effect of this is that the cold service water, which enters into the heat exchanger 6 at the inlet 18, is first heated by the heating medium, which has already been cooled, emergent at the outlet 16 and then passes in the direction of flow into the vicinity of increasingly hotter heating medium. The heat exchanger 6 comprises a second portion B in which the first flow path and the second flow path 12 are no longer guided relative to one another in a countercurrent arrangement, but are guided in a co-current arrangement, i.e. the flows in the first flow path 10 and in the second flow path 12 run parallel in the same direction along the plates separating them or other heat-conducting separation elements separating them.

A reverse portion C is formed between the first portion A and the second portion B, in which reverse portion the relative reversal of the directions of flow in the flow paths to one another is carried out. In the example shown here the portions A, B and C of the heat exchanger are integrated in one heat exchanger. However, it is to be understood that the portions A and B could also be formed in separate heat exchangers and the direction reversal of the flows to one another in portion C could be achieved by a corresponding piping between the two heat exchangers. Owing to the reversal to the co-current principle, the service water is prevented from being overheated since the heated service water emergent at the outlet 20 is not heated in the last portion of its flow path 12 directly by the hot heating medium entering at the inlet 14, but by heating medium which has already been cooled slightly. The maximum service water temperature to be achieved is thus limited. This can be seen in FIG. 10. In the diagram shown in FIG. 10 the temperature T of the heating medium is plotted as a curve 22 over the path S and the temperature T of the service water is plotted as a curve 24 over the path s. It can be seen that the outlet of the service water does not lie in the region of the highest temperature of the incoming heating medium, and in this regard a maximum temperature can be achieved which lies at the level of the temperature of the heating medium in the region of the outlet 20 of the service water from the heat exchanger.

The inlet 14 for the heating medium, the outlet 16 for the heating medium, the inlet 18 for the service water to be heated and the outlet 20 for the heated service water are formed on the plate heat exchanger 6 as fluid connection points, on which connectors are placed in turn and produce the connection to further component parts and pipelines. A first connector 26 is placed on the outlet 20 for the heated service water. This connector comprises a base element 28 which, in an identical configuration in the second connector 30 but merely rotated through 180°, is placed on the fluid connection points of the heat exchanger 6 forming the outlet 16 and the inlet 18. This affords the advantage that the same base element 28 can be used as a first connector and as a second connector and the number of different parts can be reduced.

Two separate flow ducts 32 and 34 are formed in the base element 28. The flow duct 32 is T-shaped and opens into three connection openings 36, 38 and 40 (see the sectional view in FIG. 4). When using the base element 28 as a first connector 26, the connection opening 36 is unused and closed by the wall of the heat exchanger 6, a seal 42 for sealing being arranged at the connection opening 38 between the base element 28 and the wall of the heat exchanger 6. The connection opening 38 forms the connection point for connecting to a feed line 44 which is connected to the heat accumulator 4 for supplying hot heating medium. At the connection opening 40 of the flow duct 32 arranged opposite, a first circulating pump 46 is arranged on the base element 28 during use in the first connector 26 and feeds the heating medium to the inlet 14 of the heat exchanger 6. For this purpose a third connector 48 is arranged on the inlet 14 and can be arranged, in an identical configuration but merely rotated through 180°, on the opposite side of the heat exchanger 6, as described below, as a fourth connector 50. This means, the third connector 48 and the fourth connector 50 are also formed at least of an identical base element.

A flow duct 52 is formed in the third connector 48 and connects the pressure connection of the circulating pump 46 to the inlet 14 of the heat exchanger.

As can be seen in the sectional view with reference to the second connector 30, the second flow duct 34 in the base element 28 is likewise T-shaped and comprises three connection openings 54, 56 and 58. The connection opening of the second flow duct 34 is closed in the first connector 26, for example by an inserted stopper. The connection opening 54 is connected to the outlet 20 of the heat exchanger 6, a seal 42 likewise being arranged between the connector 26 and the heat exchanger 6. In the first connector 26 a connection part 60 is placed on the connection opening 56 of the second flow duct 34 and connects the connection opening 58 to the line connection 62 via a flow duct formed inside the connection part 60. The line connection 62 connects to a hot water line, through which the heated service water is removed.

The base element 28 is placed as a second connector 30 on the opposite end face of the plate heat exchanger 6, which forms the bearing structure of the service water heating unit. The outlet 16 for the heating medium and the inlet 18 for the cold service water are connected to the external installation by the second connector 30. With this arrangement of the base element 28 rotated through 180°, the connection opening 54 of the second flow duct 34 connects to the outlet 16 of the heat exchanger. This second flow duct 34 produces a connection to the line connection or connection opening 58, which forms the outlet of the cooled heating medium. A line can be connected to this connection opening 58 and guides the heating medium back into the heat accumulator 4. In the embodiment shown in FIG. 2, in which, as will be described below, a circulation of the service water is simultaneously provided, a line 64 is connected to the connection opening 58 and leads to a switching valve 66, which selectively produces a connection of the line 64 to the connection points 68 and 70. The connection points 68 and 70 connect to the heat accumulator 4, wherein these connection points can produce, for example, a connection to the inside of the heat accumulator 4 at different vertical positions so that, depending on the temperature of the heating medium emergent from the heat exchanger 6, said heating medium can be fed back into the heat accumulator 4 at different vertical positions by switching the switching valve 66 so as to maintain a layered arrangement of the heating medium in the heat accumulator. In particular, the switching function is advantageous if, as described below, a service water circulation module 74 is provided. The heating of the circulated service water requires a lower heat demand and therefore the heating medium flows back into the heat accumulator 4 at a higher temperature.

The flow path 32 inside the base element is connected at the second connector 30 to the inlet 18 by means of the connection opening 36. A cold water line for feeding the cold service water is connected to the connection opening 38. The cold water enters the inlet 18 through this line and enters the heat exchanger.

The service water heating unit shown here can be used in two different embodiments, namely with a service water circulation module 74 or else without said service water circulation module 74. In FIGS. 1, 2, 4, 7 and 8 this service water circulation module 74 is arranged on the heat exchanger 6. FIGS. 5 and 6 show the arrangement without the service water circulation module 74. If the service water circulation module 74 is not provided, the fourth connector is not necessary and the connection opening or line connection 40 of the base element 28 of the second connector 30 is closed by a stopper. In this case, the connection opening 56 of the flow duct 34 is closed by a stopper.

The service water circulation module 74 consists of a second circulating pump 76, which circulates the service water in the hot water line system of a building. A connection part 78 and a pipe 80 are provided for connection of the second circulating pump 76. In order to mount the pump 76 on the heat exchanger 6, a fourth connector 50, for this purpose, is arranged on the end of a side face and is identical to the third connector 48 or comprises an identical base element. However, when used as a fourth connector 50, the flow duct 52 is redundant. A seat 81 is formed in the base element of the third and fourth connectors, into which seat a connection element 82 is inserted which is connected to a pressure connection of the circulating pump 76. The connection element 82 comprises, internally, a flow duct and thus produces a connection to the pipe 80. The pipe 80 is connected at its end remote from the connection element 82 to the connection opening 40 of the flow duct 32 in the second connector 30, the connection opening 40 then not being closed by a stopper. The circulating pump 46 serving as a circulation pump can thus guide some of the heated service water back into the flow duct 32 of the second connector 30 and, through the connection opening 36 thereof, into the inlet of the heat exchanger. This means, fed cold service water flowing through the connection opening 38 and service water fed back by the circulation pump 76 through the connection opening 40 flow together in the flow duct 32 of the second connector.

The connection part 48 is placed on the base element 28 of the second connector 30 in such a way that it engages in the connection opening 56 of the second flow duct 34 by a closed connecting piece 84 and thus closes the connection opening 56 in such a way that an additional stopper is no longer necessary to close said connection opening in the second connector 30. For the rest, the connection part 78 is tubular and connects two connection openings 86 and 88 located at opposite ends. The connecting piece 84 does not comprise a fluid connection to the connection between the line connections and connection openings 86 and 88. The connection opening 86 is connected to the intake connection of the second circulating pump 76 and the connection opening 88 forms a connection point to which a circulation line 90 is connected. By using the connection part 78 and a fourth connector 50, of which the base element is identical to the third connector 48, a second circulating pump 76, which constitutes a circulation pump, can likewise thus be fastened, with few additional parts, to the heat exchanger 6 serving as a bearing structure, and the circulation line can be directly connected, in fluid communication, to the second flow path 12 inside the heat exchanger via the circulating pump 46.

A sensor holder 92 is formed in the flow duct 32 in the base element 28 of the first and second connectors 26 and 30 and can be used to accommodate a sensor. When the base element 28 is used as a second connector 30, the sensor holder 92 is closed if no service water circulation module 74 is assembled. A temperature sensor 94 is placed in the sensor holder 92 in the first connector 26 and detects the temperature of the heating medium fed to the heat exchanger 6. With use of the service water circulation module 74, a temperature sensor 96 is also placed in the sensor holder 92 of the base element 28 of the second connector 30 and detects a service water demand, the specific functioning of this temperature sensor being described below. Furthermore, the connection part 60 also comprises a sensor holder in which a sensor 98 is placed. The sensor 98 is a combined temperature and flow sensor which detects the temperature and flow rate of the heated service water emergent from the outlet 20 from the heat exchanger 6 via the flow path 34 in the first connector 26. It is to be understood that the temperature sensors 94, 96 described above could also be used as combined temperature and flow rate sensors if necessary.

Owing to the sensor 98, the temperature of the emergent service water can be detected and, based on this temperature and on the temperature of the heating medium detected by the temperature sensor 94, the necessary volume flow rate of the heating medium can be determined and the first circulating pump 46 can be operated accordingly. The control or regulator for the circulating pump 46 necessary for this is preferably integrated into the circulating pump 46 as regulating or control electronics.

The sensors 94, 96 and 98 are connected via electrical lines 99 to a sensor box 100 which forms a data detection module. The sensor box 100 detects the data provided by the sensors 94, 96 and 98. As shown in FIG. 13, the sensor box 100 makes available the detected data of the control unit 101, which is integrated in this example into the control electronics of the pump unit 46. For this purpose an output interface 102 is provided in the sensor box 100 and a corresponding input interface 104 is provided in the control unit 101. The output interface 102 and the input interface 104 are formed, in this instance, as air interfaces which enable a wireless signal transmission from the sensor box 100 to the control unit 101 in the pump unit 46. This enables a very simple connection of the pump unit 46 and also of the sensors 94, 96 and 98, since these do not have to be connected directly to the pump unit 46. The sensors 94, 96 and 98 can thus be connected and wired independently of the circulating pump 46, and the circulating pump 46 can also be easily replaced, if necessary, without interfering with the wiring of the sensors. The control unit 101 in the circulating pump 46 preferably controls and regulates not only the circulating pump 46, but also the circulating pump 76, for which purpose the control unit 101 in the circulating pump 46 can communicate, preferably likewise wirelessly via radio, with the circulating pump 76 and the control device thereof. Both circulating pumps 46 and 76 can thus be connected very easily since only one electric connection is necessary for the mains power supply. The control communicates in a completely wireless manner.

Signal conditioning of the signals supplied by the sensors 94, 96 and 98 may also take place in the data detection module 100 or the sensor box 100 in order to provide the necessary data to the control device 101 in a predetermined format. The control unit 101 preferably reads from the output interface 102, via the input interface 104, only the data currently required for the control and therefore the data communication can be confined to a minimum.

The control unit 101 preferably also controls the circulation effected by the circulating pump 76 with use of the service water circulation module 74, in such a way that the circulating pump 76 is switched off for circulation when the temperature sensor 94 detects a temperature of the heating medium fed from the heat accumulator 4 which lies below a predetermined threshold value. The heat accumulator 4 can thus be prevented from cooling excessively owing to the service water circulation, and the circulation can instead be interrupted at times at which the heat supply to the heat accumulator 4 is too low, for example owing to a lack of solar irradiation on a solar module.

The control unit 101 controls the operation of the circulating pump 46 in such a way that the circulating pump 46 is first switched on when a heat demand for heating the service water is given, such that heating medium is fed from the heat accumulator 4 to the heat exchanger 6. If no service water circulation module 74 is provided, this heat demand for the service water is detected via the combined temperature/flow rate sensor 98. If this sensor detects a flow in the flow path through the connection part 60, i.e. a flow of service water, this means that a tap point for hot service water is open, such that cold service water flows in through the connection opening 38 and a heat demand for heating the service water is given. The control unit 101 can thus start up the circulating pump 46 in this case.

If the service water circulation module 74 is provided, the service water demand cannot be detected since the sensor 98, also owing to the circulation effected by the second circulating pump 76, detects a flow when no tap point for service water is open. In this case merely the temperature of the service water emergent from the heat exchanger 6 can be detected by the sensor 98 and, if this is below a predetermined threshold value, the circulating pump 46 can be switched on in order to compensate for the heat losses caused by circulation, in such a way that heating medium is fed to the heat exchanger 6 and the circulated service water is thus heated.

In this case the temperature sensor 96 is used in order to detect a service water demand owing to the opening of a tap point 7. As illustrated schematically in FIG. 11, this temperature sensor is not arranged precisely at the junction of the flow duct 32 in the base element 28 into which the portions of the flow duct from the connection openings 36 and 38 and 40 merge, but instead is offset from this junction towards the connection opening 38. This means, the temperature sensor 96 is located in the portion of the flow duct through which the cold service water is fed. If a tap point for heated service water is opened, this leads to a flow of cold service water in this line portion, such that a decrease in temperature is detected, as can be seen in the lower curve in FIG. 12, by the sensor 96 in the portion of the first flow duct 32, which runs to the connection opening 38. When such a decrease in temperature is detected, the control unit 101 switches on the circulating pump 46 for the supply of heating medium. A plurality of successive service water requests are illustrated in FIG. 12, which each lead again to a decrease in temperature and, once the request for heated service water is over, lead again to a rise in temperature since the water in the line portion in which the temperature sensor 96 is arranged is heated again.

In the second connector 30 the temperature sensor 96 is arranged slightly above the junction where the flow paths or portions of the flow duct 32 from the connection openings 36, 38 and 40 meet. It is thus ensured that the water in the line portion in which the sensor 96 is located is slowly heated again, when the tap point for service water is closed and there is thus no flow, by heat transfer by the service water circulated by the circulating pump 46 so as to flow from the connection opening 40 to the inlet 16.

As already described above, the heat exchanger 6 forms the bearing element of the service water heating unit 2, on which the connectors 26, 30, 48 and optionally 50 are fastened to the pumps 46 and optionally 76 and to the sensor box 100. The service water heating unit 2 thus forms an integrated module which can be incorporated as a prefabricated unit into a heating installation or into a heating system. The circulating pumps 46 and 76 are arranged relative to the heat exchanger 6 in such a way that their axes of rotation X extend parallel to the surfaces of the plates, in particular the outer plates 13. A holding device in the form of a clip 106 is mounted on the heat exchanger 6 in order to in turn fasten the heat exchanger 6 with the components mounted thereon to the heat accumulator 4 or to another element of a heating installation. The clip 106 forms a fastening device for fastening to the heat accumulator 4 and further forms handle elements 108 at which the entire service water heating unit 2 can be gripped, it thus being possible to handle the entire unit in a simple manner during assembly.

FIG. 14 shows a specific arrangement of service water heating units 2. In this arrangement four service water heating units 2 according to the description above are connected in parallel in a cascade-like manner in order to satisfy a greater service water demand. In the example illustrated, four service water heating units 2 are shown. However, it is to be understood that fewer or more service water heating units 2 can also be arranged accordingly depending on the maximum service water demand. In the example shown all service water heating units 2 are supplied with heating medium from a common heat accumulator 4. The service water heating units 2 are identical, except for one. The first service water heating unit 2, the one which is arranged beside the heat accumulator 4 in FIG. 14, is formed according to the design which is shown in FIGS. 1, 2, 4, 7, 8 and 11, i.e. this first service water heating unit 2 comprises a service water circulation module 74. The service water circulation module 74, which comprises the second circulating pump 46, is connected to the circulation line 90. This connects, at the tap point 7 located farthest away, to the line for heated service water DHW. Heated service water can thus be circulated through the entire line system, which supplies the tap points 7 with heated service water. The functioning of this service water heating unit 2 comprising a service water circulation module 74 basically corresponds to the description above. The three other service water heating units 2 are formed without a service water circulation module 74, i.e. as shown in FIG. 5.

Each of the service water heating units 2 according to FIG. 14 comprises a control unit 101 integrated into the circulating pump 46 and a separate sensor box 100. The individual control units 101 of the plurality of service water heating modules 2 communicate with one another via air interfaces 110 (see FIG. 13). In the first service water heating unit 2 the air interface 110 can also be used for communication with the second circulating pump 76 and optionally with the switching valve 66. However, it is also possible for the switching valve 66 to be controlled via the sensor box 100 and, for this purpose, is connected to the sensor box 100 via an electric connection line.

The control units 101 of all service water heating units 2 are formed identically and together control the cascade arrangement, as will now be described in greater detail with reference to FIG. 15.

In FIG. 15 the four service water heating units 2 are denoted as M1, M2, M3 and M4. In the small boxes arranged beneath, the numbers 1 to 4 denote the starting sequence of the service water heating units 2. The service water heating unit 2 which has position 1 in the starting sequence (in the first step M2) adopts a management function, i.e. is the managing service water heating unit 2, i.e. of which the control unit 101 also allows the further service water heating units 2 to be switched on and off.

If there is a service water request, i.e. one of the tap points 7 is opened, this is detected in the managing service water heating unit 2, as described above, by the combined temperature/flow rate sensor 98. The service water heating units 2 denoted by M2 to M4 are the service water heating units 2 shown in FIG. 14 without a service water circulation module 74. The service water heating unit 2 comprising the service water circulation module 74 is the module denoted in FIG. 15 by M1. This never adopts a managing function. If the managing module M2 now detects a service water request in step A, this service water heating unit 2 is started up first, i.e. the circulating pump 46 feeds heating medium to the associated heat exchanger 6. If the service water request is now switched off from steps B to C, this managing service water heating unit 2 is still heated in step C. If there is now a new service water request from steps C to D as a result of the opening of a tap point 7, this managing service water heating unit 2 (M2) is thus started up again. If the service water demand now increases, for example by the opening of a further tap point 7, a next service water heating unit 2 is switched on in step E in that the control unit 101 of the managing service water heating unit 2 (M2) of the service water heating unit 2 in the second position in the starting sequence (in this case M3) sends a signal for start-up. Its control unit 101 then accordingly starts up the circulating pump 46 of this further service water heating unit 2 (M3) in order to supply the heat exchanger 6 thereof with heating medium.

If the service water request is again stopped from step E to step F, the service water heating unit 2 is switched off and the control units 101 of the individual service water heating units 2 again determine the starting sequence among themselves. This occurs in that the service water heating unit 2 which was switched on last now adopts the first position in the starting sequence, and the service water heating unit 2 which was switched on first, i.e. the previously managing service water heating unit 2, returns to the last position (in this case M2). The managing function also changes accordingly to the service water heating unit 2 which is now in the first position in the starting sequence (M2). A uniform utilisation of the service water heating units 2 is thus ensured and the service water heating unit 2 which is started up first is simultaneously preferably a service water heating unit 2 which still contains residual heat. The service water heating unit 2 comprising the service water circulation module 74 always maintains the last position in the starting sequence, i.e. it is only switched on with maximum load and, for the rest, merely heats circulated service water. Should a service water heating unit 2 be faulty or fail, it is removed completely from the starting sequence, i.e. it is no longer started up at all. All this occurs by communication of the identical control units 101 with one another, and therefore a central control can be omitted.

A valve 112, which is not described above with reference to FIGS. 1 to 13, is additionally arranged in the inlet line for cold service water DCW of each service water heating unit 2 in order to switch off the service water heating units 2 when they are not heating service water. This valve 112 is controlled by the control unit via the sensor box 100. The valve 112 is preferably connected via an electrical connection line to the sensor box 100 and the control unit 101 sends a signal to the sensor box 100, via the input interface 104 and the output interface 102, to open and close the valve 112. If the valve 112 is closed, no service water flows through the respective heat exchanger 6, such that cold service water is prevented from flowing through the heat exchanger 6 of the unused service water heating units 2 into the outlet line for heated service water DHW.

The temperature control of the heated service water DHW in a service water heating unit 2 according to the above description will now be described with reference to FIG. 16. A regulator 114 is arranged in the control unit 101 and a setpoint temperature $T_{ref}$ for the heated service water DHW is predetermined for this regulator. For example, this setpoint temperature can be adjusted at the control unit 101 in the circulating pump 46. For this purpose control elements may be provided on the circulating pump 46. Alternatively, an adjustment may also be made via a wireless interface, for example infrared or radio, by means of remote operation or via system automation. The actual temperature $T_{DHW}$ of the heated service water DHW detected by the sensor 98 is subtracted from the setpoint value $T_{ref}$. The difference is fed to the regulator 114 as an error $\Delta T$. This outputs a setpoint speed $\omega_{ref}$ for the circulating pump 76, at which the circulating pump 46 is controlled, such that it feeds a volume flow $Q_{CH}$ of heating medium to the heat exchanger 6. The incoming cold service water DCW is then heated in this heat exchanger 6, such that it has the output temperature $T_{DHW}$ on the outlet side of the heat exchanger 6. This actual value $T_{DHW}$ is then, as described, detected by the sensor 98 and again fed to the regulator. This means, in accordance with the invention the speed of the circulating pump 46 and therefore the volume flow $Q_{CH}$ of the heating medium is controlled as a function of the output temperature of the hot service water DHW.

In this example, a disturbance variable feedforward is further provided in the regulator 114 in order to achieve a rapid response characteristic. For this purpose, the volume flow rate of the service water is also detected by the sensor 98 and this service water volume flow rate $Q_{DHW}$ is sent to the regulator 114 as a disturbance variable. Furthermore, the temperature $T_{CHin}$ of the heating medium fed to the heat exchanger 6 by the circulating pump 46 is detected by the temperature sensor 94 and is sent to the regulator 114 as a disturbance variable. Taking into account this disturbance variable, the setpoint speed $\omega_{ref}$ of the circulating pump 46 is accordingly adjusted, such that even the speed of the circulating pump 46 can be increased, for example with cooler heating medium and/or greater service water volume flow rate, in order to reach more quickly the required setpoint temperature $T_{ref}$ for the service water to be heated. A further disturbance variable or a further parameter which affects the service water temperature $T_{DHW}$ is the temperature $T_{DCW}$ of the incoming cold service water DCW. In the example shown, however, this is not sent to the regulator 114 as a disturbance variable, since the cold water temperature is generally basically constant. However, if the cold water temperature is subjected to considerable fluctuations, it would be conceivable to also send the temperature $T_{DCW}$ to the regulator 114 as a disturbance variable.

LIST OF REFERENCE NUMERALS

2—service water heating unit
4—heat accumulator
6—heat exchanger
7—tap point
8—housing
10—first flow path for the heating medium
12—second flow path for the service water
13—outer plates
14—inlet
16—outlet
18—inlet
20—outlet
22—temperature curve of the heating medium
24—temperature curve of the service water
26—first connector
28—base element
30—second connector
32, 34—flow ducts
36, 38, 40—connection openings or line connections
42—seals
44—feed line
46—first circulating pump
48—third connector
50—fourth connector
52—flow duct
54, 56, 58—connection openings or line connections
60—connection part
62—line connection
64—line
66—switching valve
68, 70 connection points
72—cold water line
74—service water circulation module
76—second circulating pump
78—connection part
80—pipe
81—seat
82—connection element
84—connecting piece
86, 88—connection openings
90—circulation line
92—sensor holder
94, 96—temperature sensors

97—junction
98—sensor
99—lines
100—sensor box
101—control unit or control and regulation electronics
102—output interface
104—input interface
106—clip
108—handle
110—radio interface
112—valve
DCW—cold service water
DHW—hot service water
CHO—hot heating medium, heating medium feed
CHR—cold heating medium, heating medium return
$T_{ref}$—setpoint temperature
$T_{DHW}$—temperature of the heated service water
$T_{DCW}$—temperature of the cold service water
$T_{CHin}$—temperature of the heating medium
$Q_{DHW}$—service water volume flow rate
$Q_{CH}$—heating medium volume flow rate
ΔT—error
$\omega_{ref}$—setpoint speed

The invention claimed is:

1. A heat exchanger unit (2) comprising:

a plate heat exchanger (6) having first and second flow paths extending therethrough, the first and second flow paths being separated from one another by plates of the heat exchanger and the first flow path being configured for flow of a heating medium therethrough and the second flow path being configured for flow of service water therethrough, such that the service water is heated across the plates by the heating medium, the plate heat exchanger further having a first fluid connection point (20) and a second fluid connection point (18), a first connector (26) having at least one plastic base element (28) removably attached to the plate heat exchanger, the at least one base element (28) comprising at least two distinct and separate flow ducts (32, 34), wherein there is no fluid communication between the at least two distinct and separate flow ducts within the base element of the first connector, and wherein a second flow duct of the at least two flow ducts in the base element of the first connector is fluidly connected to the first fluid connection point (20) of the plate heat exchanger (6); and a second connector (30) having at least one plastic base element (28) removably attached to the plate heat exchanger, the at least one base element of the second connector having at least two distinct and separate flow ducts (32, 34), wherein there is no fluid communication between the at least two distinct and separate flow ducts within the base element of the second connector, and wherein a first flow duct of the at least two flow ducts in the base element in the second connector is fluidly connected to the second fluid connection point of the plate heat exchanger;

wherein the at least one base element of the first connector and the at least one base element of the second connector have an identical configuration.

2. The heat exchanger unit according to claim 1, wherein the first connector (26) further comprises a connection part (60, 78) connected to the base element (28) of the first connector, the connection part including an internal flow duct also connected to the second flow duct in the base element (28) of the first connector.

3. The heat exchanger unit according to claim 1, wherein the first fluid connection point (20) is arranged on a first side of the plate heat exchanger (6) and the second fluid connection point (18) is arranged on a second side of the plate heat exchanger (6).

4. The heat exchanger unit according to claim 1, wherein the plate heat exchanger (6) further comprises a third fluid connection point, a second flow duct (34) of the at least two flow ducts of the base element in the second connector being connected to the third fluid connection point.

5. The heat exchanger unit according to claim 4, wherein the third fluid connection point is located on a same side of the plate heat exchanger as the second fluid connection point.

6. The heat exchanger unit according to claim 1, wherein at least one of the at least two flow ducts of the respective base elements of the first (26) and second (30) connectors includes a holder (92) for a sensor (94, 96).

7. The heat exchanger unit according to claim 1, further comprising a third connector (48) attached to the plate heat exchanger (6), and wherein the plate heat exchanger further comprises third and fourth (14) fluid connection points, the third connector (48) being on a same side of the plate heat exchanger as the first fluid connection point (20), and being connected to the fourth fluid connection point (14) of the plate heat exchanger (6).

8. The heat exchanger unit according to claim 7, wherein the third connector (48) fastens and connects a circulating pump (46), a flow duct (52) inside the third connector (48) connecting a first connection point of the circulating pump (46) to the fourth fluid connection point (14) of the plate heat exchanger (6).

9. The heat exchanger unit according to claim 8, wherein the circulating pump (46) is connected via a second connection point thereof to the first connector (26), the circulating pump (46) being connected to a first flow duct (32) of the first connector (26), the first flow duct not being directly connected to a fluid connection point of the plate heat exchanger (6) and forming a connection to a line connection (38) on the first connector (26).

10. The heat exchanger unit according to claim 9, wherein the first flow duct (32) in the first connector (26) is closed and is connected to a connection opening (36) facing the plate heat exchanger.

11. The heat exchanger unit according to claim 7, further comprising a fourth connector (50) attached to the plate heat exchanger and fastened to a side of the second connector (30), the fourth connector (50) comprising at least one base element, identical to a base element of the third connector (48).

12. The heat exchanger unit according to claim 11, wherein the fourth connector (50) is not directly connected to a fluid connection point of the plate heat exchanger (6).

13. The heat exchanger unit according to claim 11, wherein the fourth connector (50) connects to a second circulating pump (76).

14. The heat exchanger unit according to claim 13, wherein the second circulating pump (76) is connected between the second (30) and fourth (50) connectors, a flow duct (32) in the second connector (30) forming a fluid connection from the second circulating pump (76) to the fluid connection point (18) of the plate heat exchanger (6).

15. A heat exchanger unit (2) comprising:

a plate heat exchanger (6) having first and second flow paths extending therethrough, the first flow path being configured for flow of a heating medium therethrough and the second flow path being configured for flow of service water therethrough, such that the service water is heated by the heating medium within the plate heat exchanger, the plate heat exchanger further having a first fluid connection point (20) and a second fluid connection point (18), a first connector (26), attached to the first fluid connection point (20) of the plate heat exchanger (6), and a second connector (30) fastened to the plate heat exchanger (6), wherein the first (26) and second (30) connectors each comprise at least one base element (28), wherein the base element of the first connector and the base element of the second connector have an identical configuration and each base element comprises at least two distinct flow ducts (32, 34) in the base element, a second flow duct of the at least two flow ducts in the base element of the first connector being connected to the first fluid connection point of the plate heat exchanger and a first flow duct of the at least two flow ducts in the base element in the second connector being connected to the second fluid connection point of the plate heat exchanger, wherein the second flow duct (34) in the base element of the first connector (26) comprises a connection opening (54) which is connected to the first connection point (20) of the plate heat exchanger (6), and which branches into first and second line connections (56, 58) of the second flow duct (34), and, wherein a second flow duct (32) of the at least two flow ducts in the base element of the second connector (30) comprises a connection opening (36) which is connected to the second fluid connection point (18) of the plate heat exchanger (6), and which branches into first and second line connections (38, 40) of the second flow duct (32) in the base element of the second connector (30).

* * * * *